US008063860B2

(12) United States Patent
Choi et al.

(10) Patent No.: US 8,063,860 B2
(45) Date of Patent: Nov. 22, 2011

(54) DISPLAY DEVICE

(75) Inventors: Jin-Young Choi, Seoul (KR); Jin Jeon, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 715 days.

(21) Appl. No.: 11/827,965

(22) Filed: Jul. 13, 2007

(65) Prior Publication Data

US 2008/0030445 A1 Feb. 7, 2008

(30) Foreign Application Priority Data

Aug. 1, 2006 (KR) ..... 10-2006-0072698

(51) Int. Cl.
*G09G 3/36* (2006.01)

(52) U.S. Cl. ..... 345/87; 345/98; 345/100; 345/204; 345/76; 345/82

(58) Field of Classification Search ..... 345/98, 345/100, 204
See application file for complete search history.

(56) References Cited

U.S. PATENT DOCUMENTS 6,545,653 B1 * 4/2003 Takahara et al. ..... 345/87
2004/0104882 A1 6/2004 Kitani et al.

FOREIGN PATENT DOCUMENTS

| | | |
|---|---|---|
| JP | 2000-75840 | 3/2000 |
| JP | 2000-98335 | 4/2000 |
| JP | 2004-362745 | 12/2004 |
| JP | 2005-4120 | 1/2005 |
| JP | 2005-202422 | 7/2005 |
| KR | 2002-0069661 | 5/2002 |
| KR | 2003-0095467 | 12/2003 |
| KR | 0487439 | 4/2005 |
| KR | 0493385 | 5/2005 |
| KR | 2006-022510 | 3/2006 |

OTHER PUBLICATIONS

Trek, Inc., Trek Application Note, No. 6001, Rev. 2, p. 1, by Dr. Maciej A. Noras, 2004, entitled: Voltage level shifting.*
Patent Abstracts of Japan, Publication No. 2000-075840, Mar. 14, 2000, 1 p.
Patent Abstracts of Japan, Publication No. 2000-098335, Apr. 7, 2000, 1 p.
Patent Abstracts of Japan, Publication No. 2004-362745, Dec. 24, 2004, 1 p.

(Continued)

*Primary Examiner* — Richard Hjerpe
*Assistant Examiner* — Jeffrey Steinberg
(74) *Attorney, Agent, or Firm* — Innovation Counsel LLP

(57) ABSTRACT

In one embodiment, a display device includes a plurality of gate lines transmitting normal gate signals, a plurality of data lines crossing the gate lines and transmitting data voltages, and a plurality of storage electrode lines extending in parallel to the gate lines and transmitting storage signals. The display device may further include a plurality of pixels arranging in a matrix, each pixel having a switching element connected to the gate line and the data line, a liquid crystal capacitor connected to the switching element and a common voltage, and a storage capacitor connected to the switching element and the storage electrode line. The display device may further include a plurality of pseudo gate driving circuits generating pseudo gate signals based on the normal gate signals, and a plurality of storage signal generating circuits generating the storage signals based on the pseudo gate signals.

18 Claims, 8 Drawing Sheets

OTHER PUBLICATIONS
Patent Abstracts of Japan, Publication No. 2005-004120, Jan. 6, 2005, 1 p.
Patent Abstracts of Japan, Publication No. 2005-202422, Jul. 28, 2005, 2 pp.
Korean Patent Abstracts, Publication No. 1020020069661, Sep. 5, 2002, 2 pp.
Korean Patent Abstracts, Publication No. 1020030095467, Dec. 24, 2003, 1 p.
Korean Patent Abstracts, Publication No. 100487439, Apr. 26, 2005, 1 p.
Korean Patent Abstracts, Publication No. 100493385, May 25, 2005, 1 p.
Korean Patent Abstracts, Publication No. 1020060022510, Mar. 10, 2006, 1 p.

* cited by examiner

DISPLAY DEVICE

CROSS-REFERENCE TO RELATED APPLICATION

This application claims priority to and the benefit of Korean Patent Application No. 10-2006-0072698 filed in the Korean Intellectual Property Office on Aug. 1, 2006, the entire contents of which is incorporated herein by reference.

BACKGROUND (a) Technical Field

The present invention relates to a liquid crystal display.

(b) Related Art

In general, liquid crystal displays include two display panels having pixel electrodes and a common electrode, and a liquid crystal layer having an anisotropic dielectric interposed therebetween. The pixel electrodes are arranged in a matrix and connected to switching devices such as thin film transistors (TFTs) to sequentially receive data voltages by rows. The common electrode is disposed over the entire surface of the display panel and applied with a common voltage. The pixel electrode, the common electrode, and the liquid crystal layer interposed therebetween constitute a liquid crystal capacitor. The liquid crystal capacitor together with the switching element connected thereto form a pixel.

Liquid crystal displays may be used to display images by applying an electric field to a liquid crystal layer between the two display panels and adjusting the transmittance of light passing through the liquid crystal layer by controlling the electric field strength. If a one-directional electric field is applied to the liquid crystal layer for a long period of time, degradation of the liquid crystal display may occur. In order to prevent such degradation, the polarities of the data voltages with respect to the common voltage may be inverted for each frame, pixel row, or pixel.

However, in the case of row inversion, the range of data voltages that may be used for image display is small in comparison with the range of data voltages that may be used for pixel inversion (i.e., dot inversion). Therefore, if the threshold voltage for driving liquid crystals is high, such as in a vertical alignment (VA) mode liquid crystal display, the data voltage range used to represent grayscales for displaying images may be significantly reduced if a high threshold voltage is required for driving the liquid crystal. As a result, desired luminance cannot be obtained.

In the case of medium-sized or small-sized display devices such as mobile phones among the liquid crystal displays, row inversion (e.g., where the polarities of the data voltages with respect to the common voltage are inverted in units of a pixel row) may be performed so as to reduce power consumption. However, since the resolution of the medium-sized or small-sized display devices is gradually increasing, the power consumption associated with such devices is also increasing.

SUMMARY

According to an embodiment of the present invention, a display device includes a plurality of gate lines adapted to transmit a plurality of normal gate signals having a gate-on voltage and a gate-off voltage, a plurality of data lines crossing the gate lines and adapted to transmit a plurality of data voltages, a plurality of storage electrode lines substantially parallel to the gate lines and adapted to transmit a plurality of storage signals, a plurality of pixels arranged in a matrix having a plurality of rows, wherein each pixel comprises a switching element connected to one of the gate lines and one of the data lines, a liquid crystal capacitor connected to the switching element and a common voltage, and a storage capacitor connected to the switching element and one of the storage electrode lines, a plurality of pseudo gate driving circuits connected to the gate lines and adapted to generate a plurality of pseudo gate signals based on the normal gate signals, and a plurality of storage signal generating circuits connected to the storage electrode lines and adapted to generate the storage signals based on the pseudo gate signals. Each of the storage signal generating circuits is adapted to apply an associated storage signal to an associated one of the storage electrode lines after the liquid crystal capacitor and storage capacitors of an associated row of pixels have been charged by the data voltages.

Each of the storage signal generating circuits may be adapted to change a voltage of its associated storage signal from a low level to a high level if the data voltages have a positive polarity, and from the high level to the low level if the data voltages have a negative polarity.

The pseudo gate driving circuits may be adapted to delay the normal gate signals for a predetermined time to generates the pseudo gate signals. At this time, the predetermined time may be about two horizontal periods (2H).

The common voltage may have a constant voltage.

The display device may further include a bi-directional gate driver connected to the gate lines and adapted to generate the normal gate signals.

Each pseudo gate driving circuit may include an input unit adapted to provide an output voltage in response to a normal gate signal associated with one of the gate lines, an output unit adapted to provide one of the pseudo gate signals from a first clock signal based on a state of the output voltage, a stabilization unit connected to the output unit and supplied with the gate-off voltage, a second clock signal, and the output voltage, wherein the stabilization unit is adapted to stabilize a state of the pseudo gate signal in response to a state change of the first clock signal, and a reset unit connected to the stabilization unit and supplied with the gate-off voltage, a next pseudo gate signal associated with a next pseudo gate driving circuit next to the pseudo gate driving circuit, a previous pseudo gate signal associated with a previous pseudo gate driving circuit previous to the pseudo gate driving circuit, and the output voltage, wherein the reset unit is adapted to stabilize a state of the output voltage in response to the state change of the first clock signal, and further adapted to reset an operation of the pseudo gate driving circuit.

The second clock signal may have a pulse width substantially the same as the gate-on voltage, and the second clock signal has a phase difference of about 180 degrees with respect to the first clock signal.

The first clock signal and the second clock signal each may have a high level voltage substantially equal to the gate-on voltage and a low level voltage substantially equal to the gate-off voltage.

The difference between application times of gate-on voltages of the normal gate signal and the next pseudo gate signal or the next pseudo gate signal is about two horizontal periods (2H).

The input unit may include a first switching element having an input terminal and a control terminal connected to the normal gate signal and an output terminal adapted to provide the output voltage.

The output unit may include a second switching element having an input terminal connected to the first clock signal, a control terminal connected to the output voltage, and an output terminal adapted to provide the pseudo gate signal, and a first capacitor connected to the control terminal and the output terminal of the second switching element.

The stabilization unit may include a third switching element having an input terminal connected to the output terminal of the second switching element, a control terminal connected to the second clock signal, and an output terminal connected to the gate-off voltage; a fourth switching element having an input terminal connected to the output terminal of the second switching element and an output terminal connected to the gate-off voltage; a second capacitor connected to the first clock signal and the control terminal of the fourth switching element; and a fifth switching element having an input terminal connected to the control terminal of the fourth switching element, a control terminal connected to the output voltage, and an output terminal connected to the gate-off voltage.

The reset unit may include a sixth switching element having an input terminal connected to the output voltage, a control terminal connected to the control terminal of the fourth switching element, and an output terminal connected to the gate-off voltage, a seventh switching element having an input terminal connected to the output voltage, a control terminal connected to the next pseudo gate signal, and an output terminal connected to the gate-off voltage, and an eighth switching element having an input terminal connected to the output voltage, a control terminal connected to the previous pseudo gate signal, and an output terminal connected to the gate-off voltage.

The display device may be configured to display images in a plurality of frames, wherein each storage signal generating circuit is adapted to reverse a voltage level of its generated storage signal for every frame.

According to another embodiment of the present invention, a method of driving a display device is provided. The display device may include a plurality of pixels arranged in a matrix having a plurality of rows, wherein each pixel comprises a switching element connected to one of a plurality of gate lines and one of a plurality of data lines, a liquid crystal capacitor connected to the switching element and a common voltage, and a storage capacitor connected to the switching element and one of a plurality of storage electrode lines. The method includes applying a first set of data voltages to the data lines; generating a first normal gate signal; applying the first normal gate signal to a first gate line connected with a first row of pixels; charging the liquid crystal capacitor and storage capacitors of the first row of pixels with the first set of data voltages; generating a first pseudo gate signal based on the first normal gate signal; generating a first storage signal based on the first pseudo gate signal; applying the first storage signal to a first storage electrode line connected with the first row of pixels to maintain a voltage of the first storage signal on the storage capacitors of the first row of pixels; and repeating the preceding operations for a second set of data voltages, a second normal gate signal, a second pseudo gate signal, a second gate line connected with a second row of pixels, a second storage electrode line, and a second storage signal.

The generating the first pseudo gate signal may include delaying the first normal gate signal by a predetermined time, and the generating the second pseudo gate signal may include delaying the second normal gate signal by the predetermined time.

The predetermined time may be about two horizontal periods (2H).

The method may further include changing the voltages of the first and second storage signals from a low level to a high level if the data voltages have a positive polarity, and from the high level to the low level if the data voltages have a negative polarity.

According to another embodiment of the present invention, a display device includes a plurality of gate lines adapted to transmit a plurality of normal gate signals having a gate-on voltage and a gate-off voltage; a plurality of data lines crossing the gate lines and adapted to transmit a plurality of data voltages; a plurality of storage electrode lines substantially parallel to the gate lines and adapted to transmit a plurality of storage signals; a plurality of pixels arranged in a matrix having a plurality of rows, wherein each pixel comprises a switching element connected to one of the gate lines and one of the data lines, a liquid crystal capacitor connected to the switching element and a common voltage, and a storage capacitor connected to the switching element and one of the storage electrode lines; means for generating a plurality of pseudo gate signals based on the normal gate signals; means for generating the storage signals based on the pseudo gate signals; and means for applying an associated storage signal to an associated one of the storage electrode lines after the liquid crystal capacitor and storage capacitors of an associated row of pixels have been charged by the data voltages.

BRIEF DESCRIPTION OF THE DRAWINGS

Various embodiments of the present invention will be described in detail with reference to the accompanying drawings for clear understanding of advantages of the present invention, wherein.

DETAILED DESCRIPTION

Figure 1:
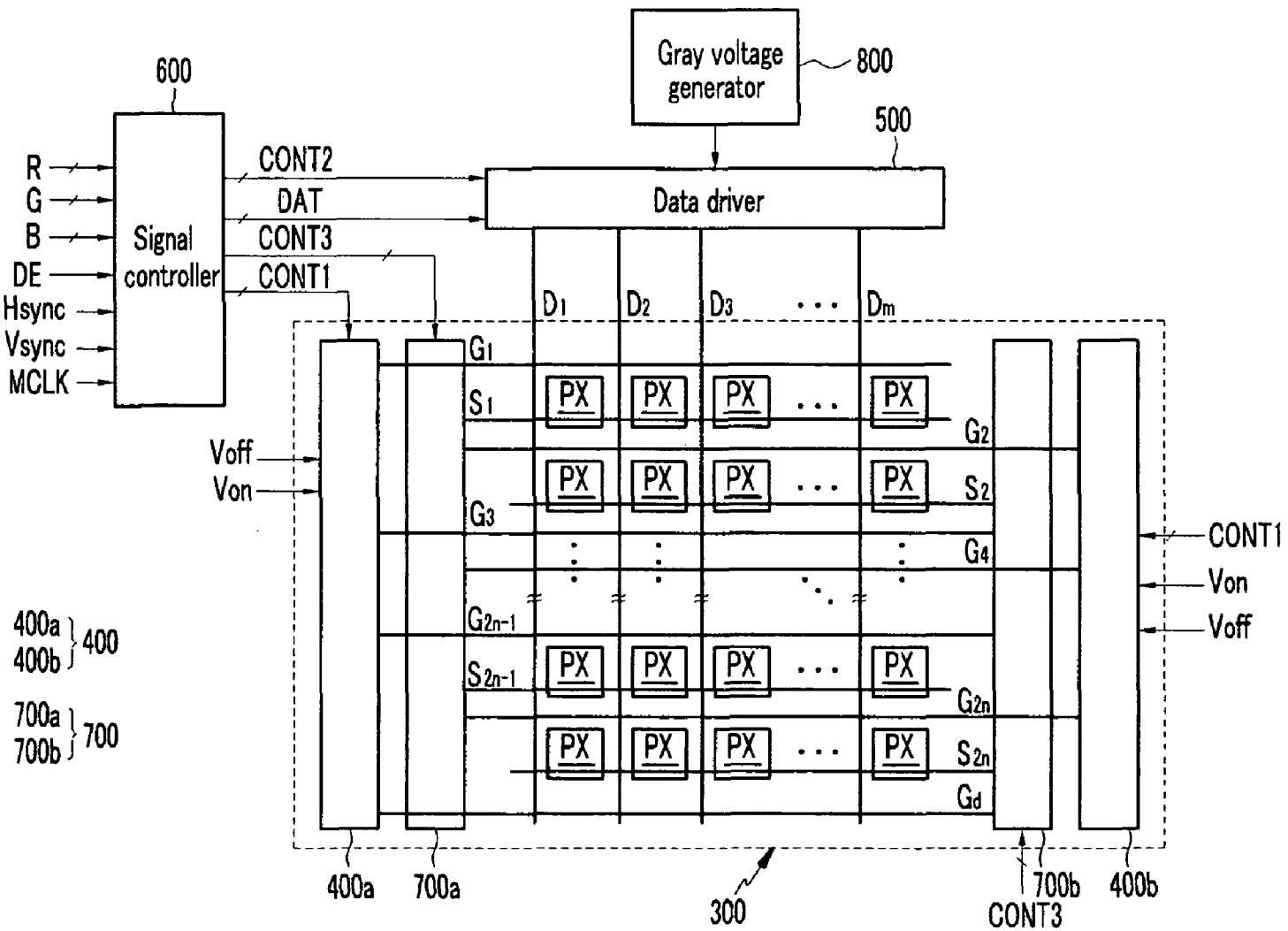
FIG. 1 is a block diagram of a liquid crystal display according to an embodiment of the present invention.

The present invention will be described more fully hereinafter with reference to the accompanying drawings, in which embodiments of the invention are shown.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present.

Figure 2:
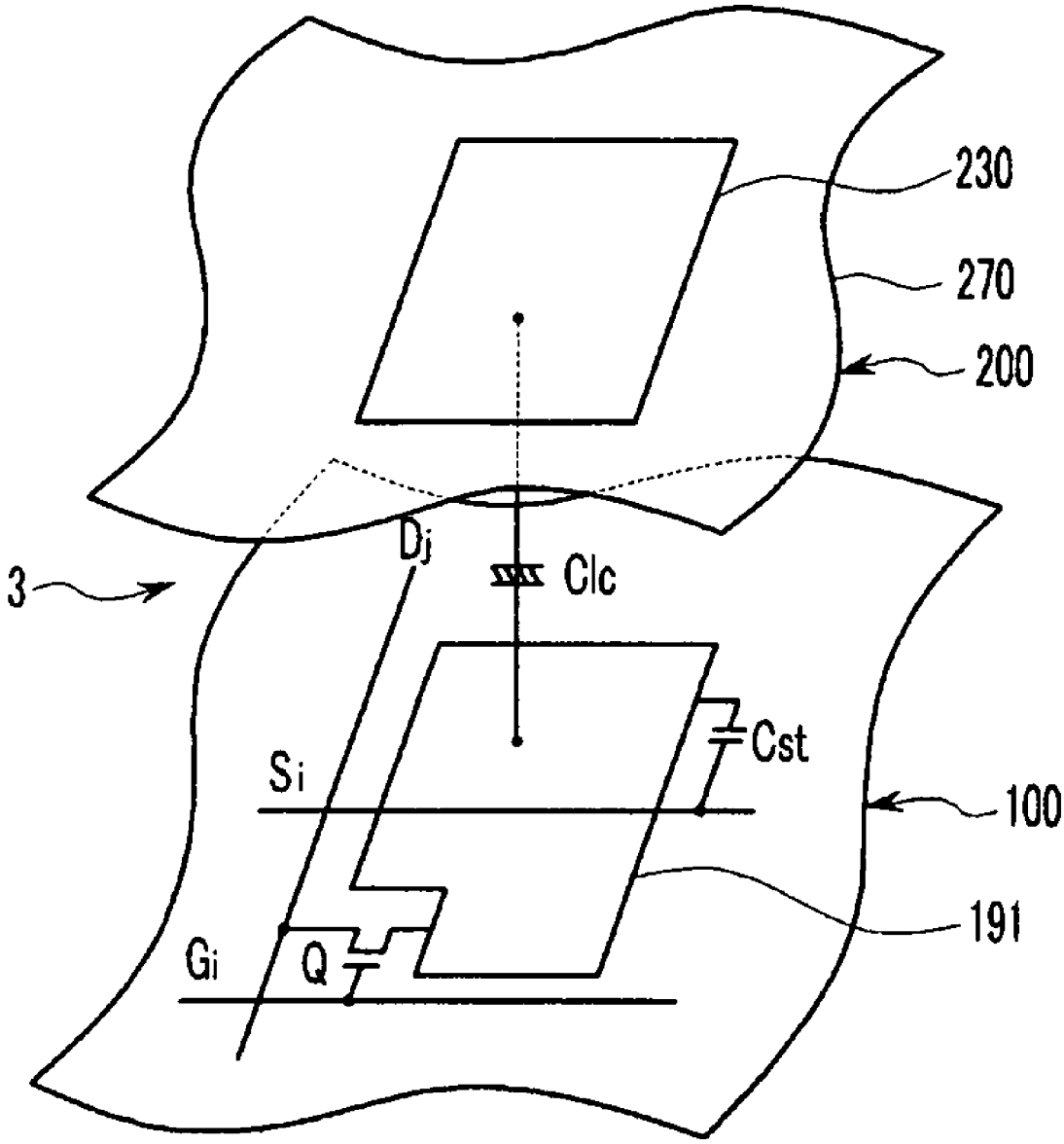
FIG. 2 is an equivalent circuit diagram of one pixel in the liquid crystal display according to an embodiment of the present invention.

First, a liquid crystal display according to an embodiment of the present invention will be described in detail with reference to FIGS. 1 and 2. FIG. 1 is a block diagram of a liquid crystal display according to an embodiment of the present invention, and FIG. 2 is an equivalent circuit diagram of one pixel in the liquid crystal display of FIG. 1.

As shown in FIG. 1, a liquid crystal display includes a liquid crystal (LC) panel assembly 300, a gate driver 400, a data driver 500 connected to the LC panel assembly 300, a gray voltage generator 800 connected to the data driver 500, a storage signal generator 700, and a signal controller 600 that controls these components The LC panel assembly 300 includes a plurality of signal lines $G_1$-$G_{2n}$, $G_d$, $D_1$-$D_m$, and $S_1$-$S_{2n}$ and a plurality of pixels PX. As shown in FIG. 2, the LC panel assembly 300 includes lower and upper panels 100 and 200 facing each other and an LC layer 3 interposed between the panels 100 and 200.

The signal lines include a plurality of gate lines $G_1$-$G_{2n}$ and $G_d$, a plurality of data lines $D_1$-$D_m$, and a plurality of storage electrode lines $S_1$-$S_{2n}$.

The gate lines $G_1$-$G_{2n}$ and $G_d$ include a plurality of normal gate lines $G_1$-$G_{2n}$ and an additional gate line $G_d$ transmitting gate signals (also referred to as "scanning signals" hereinafter). The storage electrode lines $S_1$-$S_{2n}$ are alternately connected to the normal gate lines $G_1$-$G_{2n}$ and transmit storage signals. The data lines $D_1$-$D_m$ transmit data voltages.

The gate lines $G_1$-$G_{2n}$ and $G_d$ and the storage electrode lines $S_1$-$S_{2n}$ extend substantially in a row direction and substantially parallel to each other, while the data lines $D_1$-$D_m$ extend substantially in a column direction and substantially parallel to each other. As shown in FIG. 1, the pixels PX are connected to the normal gate lines $G_1$-$G_{2n}$ and the data lines $D_1$-$D_m$, and are arranged substantially in a matrix.

Referring to FIG. 2, each pixel PX, for example a pixel PX connected to the i-th normal gate line $G_i$ (i=1, 2, . . . , 2n) and the j-th data line $D_j$ (j=1, 2, . . . , m) includes a switching element Q connected to the signal lines $G_i$ and $D_j$, and a liquid crystal capacitor Clc and a storage capacitor Cst that are connected to the switching element Q.

The switching element Q may be implemented, for example as a three terminal element such as a thin film transistor, and is disposed on the lower panel 100. The switching element Q has a control terminal connected to the normal gate line $G_i$, an input terminal connected to the data line $D_j$, and an output terminal connected to the liquid crystal capacitor Clc and the storage capacitor Cst.

The liquid crystal capacitor Clc includes a pixel electrode 191 disposed on the lower panel 100 and a common electrode 270 disposed on the upper panel 200 as two terminals. The LC layer 3 interposed between the two electrodes 191 and 270 functions as a dielectric of the LC capacitor Clc. The pixel electrode 191 is connected to the switching element Q, and the common electrode 270 is disposed on the entire surface of the upper panel 200 and supplied with a common voltage Vcom. The common voltage may include a DC voltage having a predetermined magnitude. Alternatively, the common electrode 270 may be disposed on the lower panel 100, and in this case, at least one of the two electrodes 191 and 270 may be formed in a shape of a line or a bar.

The storage capacitor Cst is an auxiliary capacitor for the LC capacitor Clc. The storage capacitor Cst includes the pixel electrode 191 and a storage electrode line $S_i$ that overlaps the pixel electrode 191 via an insulator.

For color display, each pixel may uniquely represent a primary color (i.e., spatial division) or may represent the primary colors in turn (i.e., temporal division) such that a spatial or temporal sum of the primary colors is recognized as a desired color. An example of a set of the primary colors includes red, green, and blue colors. FIG. 2 shows an example of the spatial division in which each pixel includes a color filter 230 representing one of the primary colors in an area of the upper panel 200 facing the pixel electrode 191. Alternatively, the color filter 230 may be provided on or under the pixel electrode 191 on the lower panel 100.

One or more polarizers (not shown) are attached to the LC panel assembly 300.

Referring to FIG. 1 again, the gray voltage generator 800 may generate a full number of gray voltages or a limited number of gray voltages (referred to as "reference gray voltages" hereinafter) related to the transmittance of the pixels PX. Some of the (reference) gray voltages have a positive polarity relative to the common voltage Vcom, while the other (reference) gray voltages have a negative polarity relative to the common voltage Vcom.

The gate driver 400 includes first and second gate driving circuits 400*a* and 400*b* respectively arranged on both sides of the liquid crystal panel assembly 300, for example right and left sides.

The first gate driving circuit 400*a* is connected to ends of the odd-numbered normal gate lines $G_1$, $G_3$, . . . , and $G_{2n-1}$ and the additional gate line $G_d$. The second gate driving circuit 400*b* is connected to ends of the even-numbered normal gate lines $G_2$, $G_4$, . . . , and $G_{2n}$. Alternatively, the second gate driving circuit 400*b* may be connected to ends of the odd-numbered normal gate lines $G_1$, $G_3$, . . . , and $G_{2n-1}$ and the additional gate line $G_d$, and the first gate driving circuit 400*a* may be connected to ends of the even-numbered normal gate lines $G_2$, $G_4$, . . . , and $G_{2n}$.

The first and second gate driving circuits 400*a* and 400*b* synthesize a gate-on voltage Von and a gate-off voltage Voff to generate the gate signals for application to the gate lines $G_1$-$G_{2n}$ and $G_d$.

The gate driver 400 is integrated into the liquid crystal panel assembly 300 along with the signal lines $G_1$-$G_{2n}$, $G_d$, $D_1$-$D_m$, and $S_1$-$S_{2n}$ and the switching elements Q. In one embodiment, the gate driver 400 may include at least one integrated circuit (IC) chip mounted on the LC panel assembly 300 or on a flexible printed circuit (FPC) film in a tape carrier package (TCP) which is attached to the panel assembly 300. Alternatively, the gate driver 400 may be mounted on a separate printed circuit board (not shown).

The storage signal generator 700 includes first and second storage signal generating circuits 700*a* and 700*b* arranged on both sides of the liquid crystal panel assembly 300, for example, and adjacent to the first and second gate driving circuits 400*a* and 400*b*.

The first storage signal generating circuit 700*a* is connected to the odd-numbered storage electrode lines $S_1$, $S_3$, . . . , and $S_{2n-1}$ and the even-numbered normal gate lines $G_2$, $G_4$, . . . , and $G_{2n}$ and applies storage signals having a high level voltage and a low level voltage.

The second storage signal generating circuit 700*b* is connected to the even-numbered storage electrode lines $S_2$, $S_4$, . . . , and $S_{2n}$ and the odd-numbered normal gate lines $G_3$, . . . , and $G_{2n-1}$ (except for the first normal gate line $G_1$ and the additional gate line $G_d$) and applies the storage signals to the storage electrode lines $S_2$, $G_4$, . . . , and $S_{2n}$.

Instead of the storage signal generator 700 being supplied with the signal from the additional gate line $G_d$ connected to the gate driver 400, the storage signal generator 700 may be supplied with a signal from a separate unit such as the signal controller 600 or a separate signal generator (not shown). In this case, the additional gate line $G_d$ is not necessarily formed on the liquid crystal panel assembly 300.

The storage signal generator 700 is integrated into the liquid crystal panel assembly 300 along with the signal lines $G_1$-$G_{2n}$, $G_d$, $D_1$-$D_m$, and $S_1$-$S_{2n}$ and the switching elements Q. In one embodiment, the storage signal generator 700 may include at least one integrated circuit (IC) chip mounted on the LC panel assembly 300 or on a flexible printed circuit (FPC) film in a tape carrier package (TCP) which is attached to the panel assembly 300. Alternatively, the storage signal generator 700 may be mounted on a separate printed circuit board (not shown).

The data driver 500 is connected to the data lines $D_1$-$D_m$ of the panel assembly 300 and applies data voltages, which are selected from the gray voltages supplied from the gray voltage generator 800, to the data lines $D_1$-$D_m$. However, when the gray voltage generator 800 generates only some reference gray voltages rather than all the gray voltages, the data driver 500 may divide the reference gray voltages to generate the data voltages from among the reference gray voltages.

The signal controller 600 controls the gate driver 400, the data driver 500, and the storage signal generator 700.

In one embodiment, each of drivers 500, 600, and 800 may include at least one integrated circuit (IC) chip mounted on the LC panel assembly 300 or on a flexible printed circuit (FPC) film in a tape carrier package (TCP) which is attached to the panel assembly 300. Alternatively, at least one of the drivers 500, 600, and 800 may be integrated into the panel assembly 300 along with the signal lines $G_1$-$G_{2n}$, $G_d$, $S_1$-$S_{2n}$, and $D_1$-$D_m$ and the switching elements Q. Alternatively, all the drivers 500, 600, and 800 may be integrated into a single IC chip, but at least one of the drivers 500, 600, and 800 or at least one circuit element in at least one of the processing units devices 500, 600, and 800 may be disposed out of the single IC chip.

Operation of the liquid crystal display is described below.

The signal controller 600 receives input image signals R, G, and B and input control signals for controlling display thereof from an external graphics controller (not shown). The input image signals R, G, and B contain luminance information for pixels PX, and the luminance has a predetermined number of grays, for example, 1024 ($=2^{10}$), 256 ($=2^8$), or 64 ($=2^6$) grays. Examples of the input control signals are a vertical synchronization signal Vsync, a horizontal synchronization signal Hsync, a main clock signal MCLK, and a data enable signal DE.

On the basis of the input control signals and the input image signals R, G, and B, the signal controller 600 generates gate control signals CONT1, data control signals CONT2, and storage control signals CONT3, and it processes the image signals R, G, and B suitable for the operation of the panel assembly 300 and the data driver 500. The signal controller 600 sends the gate control signals CONT1 to the gate driver 400, sends the processed image signals DAT and the data control signals CONT2 to the data driver 500, and sends the storage control signals CONT3 to the storage signal generator 700.

The gate control signals CONT1 include scanning start signals STV1 and STV2 to start scanning, and at least one clock signal for controlling the output period of the gate-on voltage Von. The gate control signals CONT1 may also include an output enable signal OE for defining a duration of the gate-on voltage Von.

The data control signals CONT2 include a horizontal synchronization start signal STH for indicating the start of data transmission for a row of pixels PX, a load signal LOAD to apply the data voltages to the data lines $D_1$ to $D_m$, and a data clock signal HCLK. The data control signals CONT2 may further include an inversion signal RVS for reversing the polarity of the data voltages (relative to the common voltage Vcom).

Responsive to the data control signals CONT2 from the signal controller 600, the data driver 500 receives a packet of the digital image signals DAT for the row of the pixels PX, converts the digital image signals DAT to analog data voltages selected from the gray voltages, and applies the analog data voltages to data lines $D_1$ to $D_m$.

The gate driver 400 applies the gate-on voltage Von to a corresponding normal gate line $G_1$-$G_{2n}$, for example an i-th normal gate line $G_i$, in response to the gate control signals CONT1 from the signal controller 600, thereby turning on the switching elements Q that are connected to the normal gate line $G_i$ (except the additional gate line $G_d$ that is not connected to the switching elements Q). The data voltages applied to the data lines $D_1$-$D_m$ are then supplied to the pixels PX of the i-th row through the activated switching transistors Q such that the liquid crystal capacitor Clc and the storage capacitor Cst in the pixels PX are charged.

The difference between the data voltage and the common voltage Vcom applied to a pixel PX is represented as a voltage across the liquid crystal capacitor Clc of the pixel PX, which is referred to as a pixel voltage. The LC molecules in the LC capacitor Clc have orientations depending on the magnitude of the pixel voltage, and the molecular orientations determine the polarization of light passing through the LC layer 3. The polarizer(s) converts light polarization to light transmittance such that the pixel PX has a luminance represented by a gray of the data voltage.

With the elapse of a horizontal period (also referred to as "1H" and that is equal to one period of the horizontal synchronization signal Hsync and the data enable signal DE), the data driver 500 applies data voltages to pixels PX of an (i+1)-th row, and then the gate driver 400 changes the gate signal applied to the i-th normal gate line $G_i$ to a gate-off voltage Voff and changes the gate signal applied to the next normal gate line $G_{i+1}$ to a gate-on voltage Von.

Then, the switching elements Q of the i-th row are turned off such that the pixel electrodes 191 are in a floating state.

The storage signal generator 700 changes a voltage level of a storage signal applied to an i-th storage electrode line $S_i$, based on the storage control signals CONT3 and the voltage variation of the gate signal applied to the (i+1)-th gate line $G_{i+1}$. Thereby, a voltage of the pixel electrode 191 connected to one terminal of the storage capacitor Cst is varied in accordance with the voltage variation of the storage electrode line $S_i$ connected to another terminal of the storage capacitor Cst.

By repeating this procedure for all pixel rows, the liquid crystal display displays an image for a frame.

When the next frame starts after one frame finishes, the inversion signal RVS applied to the data driver 500 is controlled such that the polarity of the data voltages is reversed (which is referred to as "frame inversion"). In addition, the polarity of the data voltages applied to pixels PX of one row is substantially the same, and the polarity of the data voltages applied to pixels PX of the two adjacent rows is reversed (for example, row inversion).

In an embodiment of the present invention that performs frame inversion and row inversion, the polarity of all data voltages applied to pixels PX of one row is positive or negative and is changed by a unit of one frame. At this time, a storage signal applied to a storage electrode line $S_1$-$S_{2n}$ is changed from a low level voltage to a high level voltage when the pixel electrode 191 is charged by a data voltage of the positive polarity. On the other hand, the storage signal is changed from a high level voltage to a low level voltage when the pixel electrode 191 is charged by a data voltage of the negative polarity. As a result, the voltage of the pixel electrode 191 increases in a case where the pixel electrode 191 is charged by a data voltage of the positive polarity, and decreases in a case where the pixel electrode 191 is charged by a data voltage of the negative polarity. As a result, the voltage range of the pixel electrode 191 is wider than the range of the gray voltages that are the basis of data voltages such that the luminance range using a low basic voltage may be increased.

The first and second storage signal generating circuits 700*a* and 700*b* may include a plurality of signal generating circuits 710 connected to the storage electrode lines $S_1$-$S_{2n}$, respectively. An example of the signal generating circuits 710 is described with reference to FIGS. 3 and 4.

Figure 3:
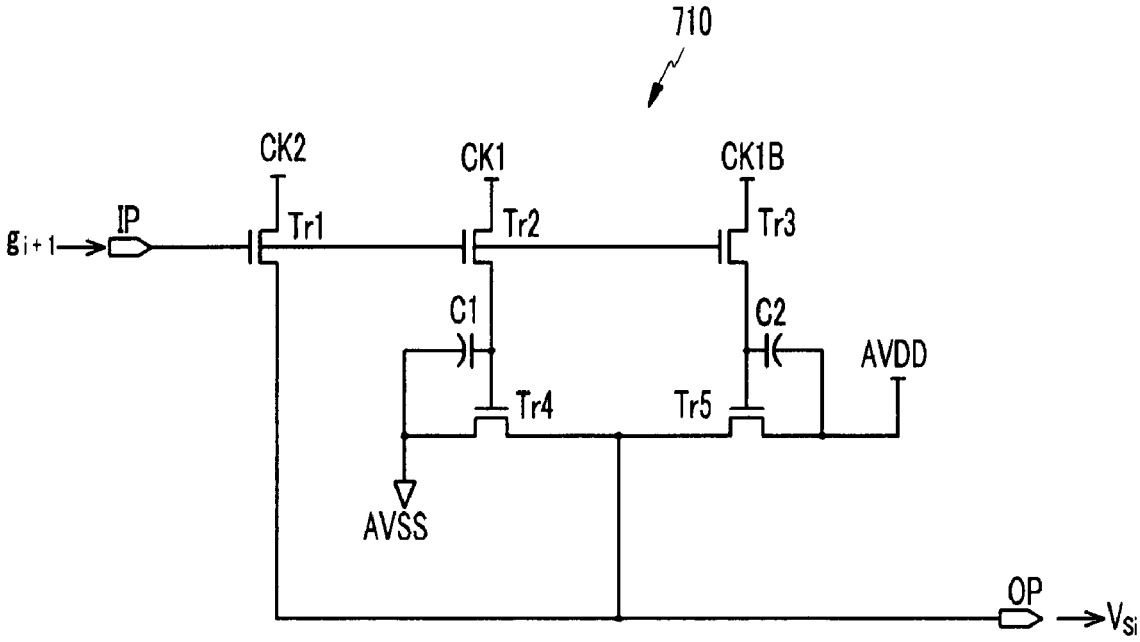
FIG. 3 is a circuit diagram of a signal generating circuit according to an embodiment of the present invention.
Figure 4:
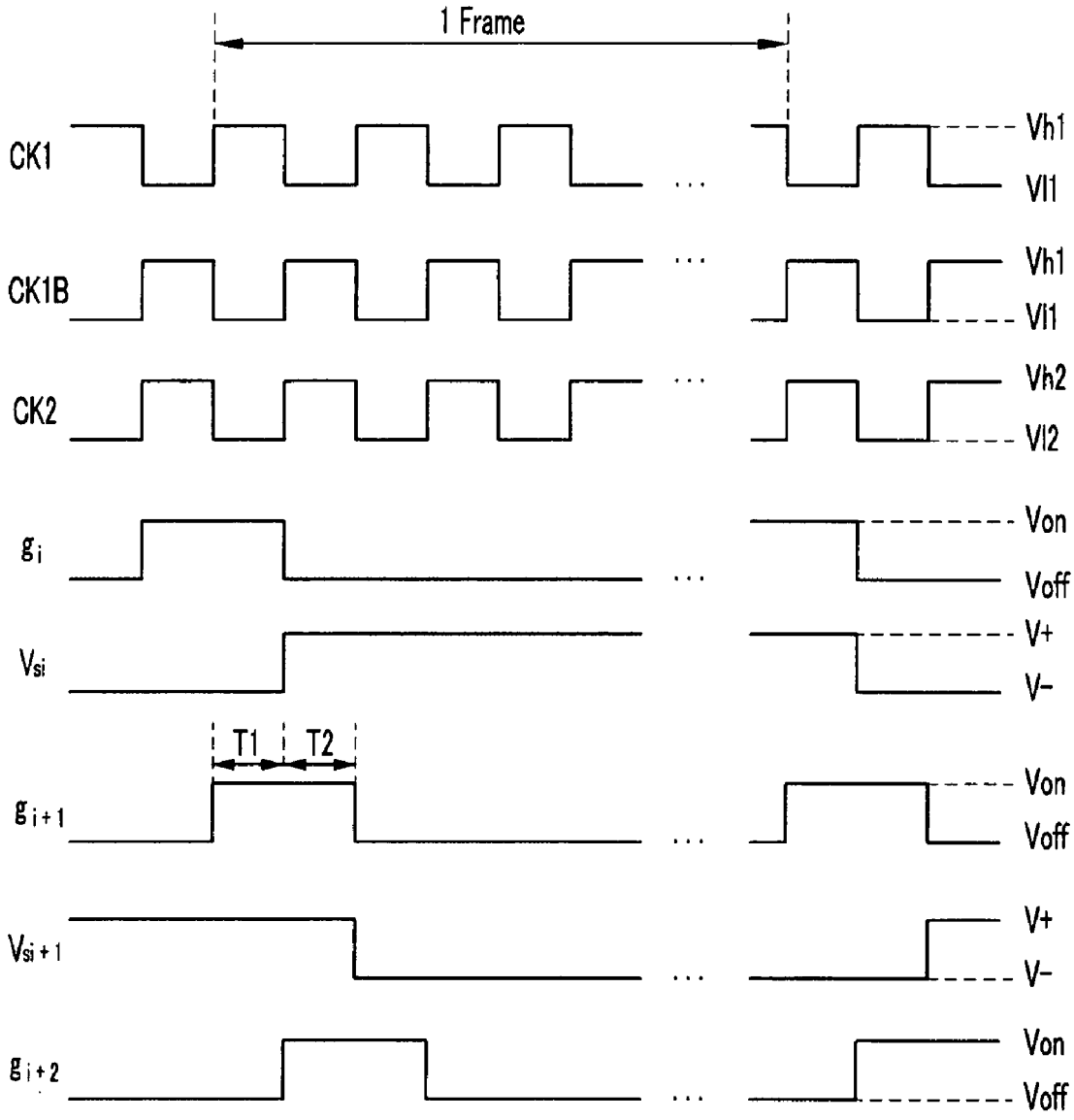
FIG. 4 is a timing diagram of signals used in the liquid crystal display including the signal generating circuit shown in FIG. 3 according to an embodiment of the present invention.

FIG. 3 is a circuit diagram of a signal generating circuit according to an embodiment of the present invention, and FIG. 4 shows a timing diagram of signals used in a liquid crystal display including the signal generating circuit shown in FIG. 3.

Referring to FIG. 3, a signal generating circuit 710 includes an input terminal IP and an output terminal OP. In an i-th signal generating circuit, the input terminal IP is connected to an (i+1)-th gate line $G_{i+1}$ to be supplied with an (i+1)-th gate signal $g_{i+1}$ (hereinafter, referred to as "an input signal"), and the output terminal OP is connected to an i-th storage electrode line $S_i$ to output an i-th storage signal $Vs_i$. Similarly, in an (i+1)-th signal generating circuit, the input terminal IP is connected to an (i+2)-th gate line $G_{1+2}$ to be supplied with an (i+2)-th gate signal $g_{i+2}$ as an input signal, and the output terminal OP is connected to an (i+1)-th storage electrode line $S_{i+1}$ to output an (i+1)-th storage signal $Vs_{i+1}$.

The signal generating circuit 710 is supplied with first, second, and third clock signals CK1, CK1B, and CK2 of the storage control signals CONT3 from the signal controller 600, and is also supplied with a high voltage AVDD and a low voltage AVSS from the signal controller 600 or an external device.

As shown in FIG. 4, the period of the first, second, and third clock signals CK1, CK1B, and CK2 may be about 2H, and a duty ratio thereof may be about 50%. The first and second clock signals CK1 and CK1B have a phase difference of about 180 degrees and are inverted with respect to each other. The second clock signal CK1B and the third clock signal CK2 have substantially the same phase. In addition, the first, second, and third clock signals CK1, CK1B, and CK2 are reversed by a unit of a frame.

The first and second clock signals CK1 and CK1B may have a high level voltage Vh1 of about 15V and a low level voltage Vl1 of about 0V. The third clock signal CK2 may have a high level voltage Vh2 of about 5V and a low level voltage Vl2 of about 0V. The high voltage AVDD may be about 5V and about equal to the high level voltage Vh2 of the third clock signal CK2, and the low voltage AVSS may be about 0V and about equal to the low level voltage Vl2 of the third clock signal CK2.

The signal generating circuit 710 includes five transistors Tr1-Tr5, each having a control terminal, an input terminal, and an output terminal, and two capacitors C1 and C2.

The control terminal of the transistor Tr1 is connected to the input terminal IP, the input terminal of the transistor Tr1 is connected to the third clock signal CK2, and the output terminal of the transistor Tr1 is connected to the output terminal OP.

The control terminals of the transistors Tr2 and Tr3 are connected to the input terminal IP, and the input terminals of the transistors Tr2 and Tr3 are connected to the first and second clock signals CK1 and CK1B, respectively.

The control terminals of the transistors Tr4 and Tr5 are connected to the output terminals of the transistors Tr2 and Tr3, respectively, and the input terminals of the transistors Tr4 and Tr5 are connected to the low and high voltages AVSS and AVDD, respectively.

The capacitors C1 and C2 are connected between the control terminals of the transistors Tr4 and Tr5 and the low and high voltages AVSS and AVDD, respectively.

In one embodiment, the transistors Tr-Tr5 may be amorphous silicon transistors or polycrystalline silicon thin film transistors.

The operation of the signal generating circuit will be further described below.

Referring to FIG. 4, gate-on voltages Von applied to two adjacent gate lines are overlapped for a time, such as about 1H. As a result, all the pixels PX of a row are charged with data voltages that are applied to pixels of an immediately previous row for about 1H, and then are charged with own data voltages for the remaining 1H to normally display images.

First, an i-th signal generating circuit will be described.

When an input signal, that is, a gate signal $g_{i+1}$ applied to an (i+1)-th gate line $G_{i+1}$ is changed into a gate-on voltage Von, the first, second, and third transistors Tr1-Tr3 are turned on. The turned-on first transistor Tr1 transmits the third clock signal CK2 to the output terminal OP. As a result, the i-th storage signal $Vs_i$ will exhibit a low level voltage Vl2 of the third clock signal CK2. Meanwhile, the turned-on transistor Tr2 transmits the first clock signal CK1 to the control terminal of the transistor Tr4, and the turned-on transistor Tr3 transmits a second clock signal CK1B to the control terminal of the transistor Tr5.

Since the first and second clock signals CK1 and CK1B exhibit an inverse relationship, the transistors Tr4 and Tr5 are operated in reverse. That is, when the transistor Tr4 is turned on, the transistor Tr5 is turned off, and on the contrary, when the transistor Tr4 is turned off, the transistor Tr5 is turned on. When the transistor Tr4 is turned on and the transistor Tr5 is turned off, a low voltage AVSS is transmitted to the output terminal OP, and when transistor Tr4 is turned off and the transistor Tr5 is turned on, a high voltage AVDD is transmitted to the output terminal OP.

Gate signal $g_{i+1}$ exhibits to gate on voltage Von, for example, for about 2H. The first half of about 1H is denoted by the first period T1 and the second half of about 1H is denoted as the latter period T2.

Since for the first period T1 the first clock signal CK1 maintains a high voltage Vh1 and the second and third clock signals CK1B and CK2 maintain low voltages Vl1 and V12, respectively, the output terminal OP to which the low voltage Vl2 of the third clock signal CK2 is transmitted by the transistor Tr1 is supplied with the low voltage AVSS. As a result, the storage signal $Vs_i$ maintains the low level voltage V– having a magnitude equal to that of the low voltage Vl2 and the low voltage AVSS. Also during the first period T1, a voltage between the high level voltage Vh1 of the first clock signal CK1 and the low voltage AVSS is charged into the capacitor C1, and a voltage between the low level voltage Vl1 of the second clock signal CK1B and the high voltage AVDD is charged into the capacitor C2.

Since for the latter period T2 the first clock signal CK1 maintains the low level voltage V11, and the second and third clock signals CK1B and CK2 maintain the high level voltages Vh1 and Vh2, respectively, the transistor Tr5 is turned on and the transistor Tr4 is turned off, opposite to the first period T1.

As a result, the output terminal OP is supplied with the high level voltage Vh2 of the third clock signal CK2 transmitted through the turned-on transistor Tr1 such that a state of the storage signal $Vs_i$ is changed from the low level voltage V− to a high level voltage V+ having a magnitude equal to that of the high level voltage Vh2. In addition, the output terminal Op is supplied with the high voltage VADD applied through the turned-on transistor Tr5, which has a magnitude equal to that of the high level voltage V+.

Meanwhile, since the voltage charged into the capacitor C1 is substantially the same as the difference between the low level voltage V11 of the first clock signal CK1 and the low voltage VASS, the capacitor C1 is discharged when the low level voltage Vl1 of the first clock signal CK1 and the low voltage VASS are the same. Since the voltage charged into the capacitor C2 is substantially the same as the difference between the high level voltage Vh1 of the second clock signal CK1B and the high voltage VADD, the voltage charged into the capacitor C2 is not 0V when the high level voltage Vh1 and the high voltage AVDD are different from each other. As described above, when the high level voltage Vh1 of the second clock signal CK1B is about 15V and the high voltage AVDD is about 5V, a voltage of about 10V is charged into the capacitor C2.

When the state of the gate signal $g_{i+1}$ is changed from the gate-on voltage Von to the gate-off voltage Voff after the latter period T2 elapses, the transistors Tr1-Tr3 are turned off. As a result, the electrical connection between the transistor Tr1 and the output terminal OP will be isolated. The control terminals of the transistors Tr4 and Tr5 will also be isolated.

Since the capacitor C1 is not charged, the transistor TR4 remains in a turned-off state. However, the voltage between the high level Vh1 of the second clock signal CK1B and the high voltage AVDD has been charged into the capacitor C2. At this time, when the charged voltage is larger than a threshold voltage of the transistor Tr5, the transistor Tr5 remains in a turned-on state. As a result, the high voltage AVDD is provided to the output terminal OP as a storage signal $Vs_i$. Accordingly, the storage signal $Vs_i$ maintains the high level voltage V+.

Next, the operation of the (i+1)-th signal generating circuit will be described.

When an (i+2)-th gate signal $g_{i+2}$ having a gate-on voltage Von is applied to the (i+1)-th signal generating circuit (not shown), the (i+1)-th signal generating circuit is operated.

As shown in FIG. 4, when the (i+2)-th gate signal $g_{i+2}$ switches to the gate-on voltage Von, the states of the first, second, and third clock signals CK1, CK1B, and CK2 are reversed such that the (i+1)-th gate signal $g_{i+1}$ has a gate-on voltage Von.

That is, the operation for the first gate-on voltage period T1 of the (i+2)-th gate signal $g_{i+2}$ is the same as that of the latter gate-on period T2 of the (i+1)-th gate signal $g_{i+1}$ such that the transistors Tr1, Tr3, and Tr5 are turned on. Accordingly, the high level voltage Vh2 of the third clock signal CK2 and the high voltage AVDD are applied to the output terminal OP. As a result, the storage signal $Vs_{i+1}$ will be at a high level voltage V+.

However, the operation for the latter gate-on voltage period T2 of the (i+2)-th gate signal $g_{i+2}$ is the same as that of the first gate-on period T1 of the (i+1)-th gate signal $g_{i+1}$ such that the transistors Tr1, Tr2, and Tr4 are turned on. Accordingly, the low level voltage Vl2 of the third clock signal CK2 and the low voltage AVSS are applied to the output terminal OP, and the storage signal $Vs_{i+1}$ is changed from the high level voltage V+ to the low voltage V−.

As described above, the transistor Tr1 may apply the third clock signal CK2 as a storage signal while an input signal maintains the gate-on voltage Von, and the remaining transistors Tr2-Tr5 may maintain a state of the storage signal until the next frame using the capacitors C1 and C2 when the output terminal OP is isolated from the output terminal of the transistor Tr1 by the gate-off voltage Voff of the input signal. That is, the transistor Tr1 may apply a storage signal to a corresponding storage electrode line, and the remaining transistors Tr2-Tr5 may uniformly maintain the storage signal. In one embodiment, the size of the transistor Tr1 is much larger than that of the transistors Tr2-Tr5.

The pixel electrode voltage Vp may increase or decrease in response to the voltage variation of the storage signal Vs. Hereinafter, each of the capacitors and the capacitance thereof are denoted by the same reference characters.

The pixel electrode voltage Vp is obtained by the following Equation 1:

$$V_p = V_D \pm \Delta = V_D \pm \frac{C_{st}}{C_{st+c_{lk}}}(V+ - V-)$$

In Equation 1, $V_D$ is a data voltage, Clc and Cst represent the capacitance of an LC capacitor and a storage capacitor, respectively, V+ represents a high level voltage of a storage signal Vs, and V− represents a low level voltage of a storage signal Vs. As shown in Equation 1, the pixel electrode voltage Vp is defined by adding or subtracting a variation amount Δ, which is defined by the capacitances Clc and Cst of the LC capacitor and the storage capacitor, respectively, and the voltage variation of the storage signal Vs from the data voltage $V_D$.

Accordingly, by adding the voltage variation of the storage signal Vs to or subtracting it from a data voltage $V_D$, the pixel electrode voltage Vp increases by the voltage variation when a pixel has been charged with a data voltage of the positive polarity, and, on the contrary, the pixel electrode voltage Vp decreases by the voltage variation when a pixel has been charged with a data voltage of the negative polarity. As a result, the variation of a pixel voltage becomes wider than the range of a gray voltage by the increased or decreased pixel electrode voltage Vp such that the range of the represented luminance also increases.

In addition, since the common voltage is fixed to a constant voltage, the power consumption is reduced in comparison with a case where the high and lower voltages are alternately applied.

According to an embodiment of the present invention, after the common voltage is fixed at a predetermined voltage, the storage signals are applied to the storage electrode lines. The voltage levels of the storage signals may be changed in a predetermined period. As a result, since a range of the pixel electrode voltage is widened, a range of the pixel voltage is also widened. Since a range of voltage for representing grays is widened, image quality can be improved.

In a case where data voltages having the same magnitude are applied, a wider range of pixel voltages can be generated in response to changes in storage signal voltage levels than in a case where a constant storage signal is applied. As a result, the range of data voltages may be reduced, thereby also reducing power consumption. In addition, since the common voltage is fixed at a constant voltage, power consumption can be further reduced.

Referring to FIGS. 5 to 8, a liquid crystal display according to an embodiment of the present invention will be described.

Figure 5:
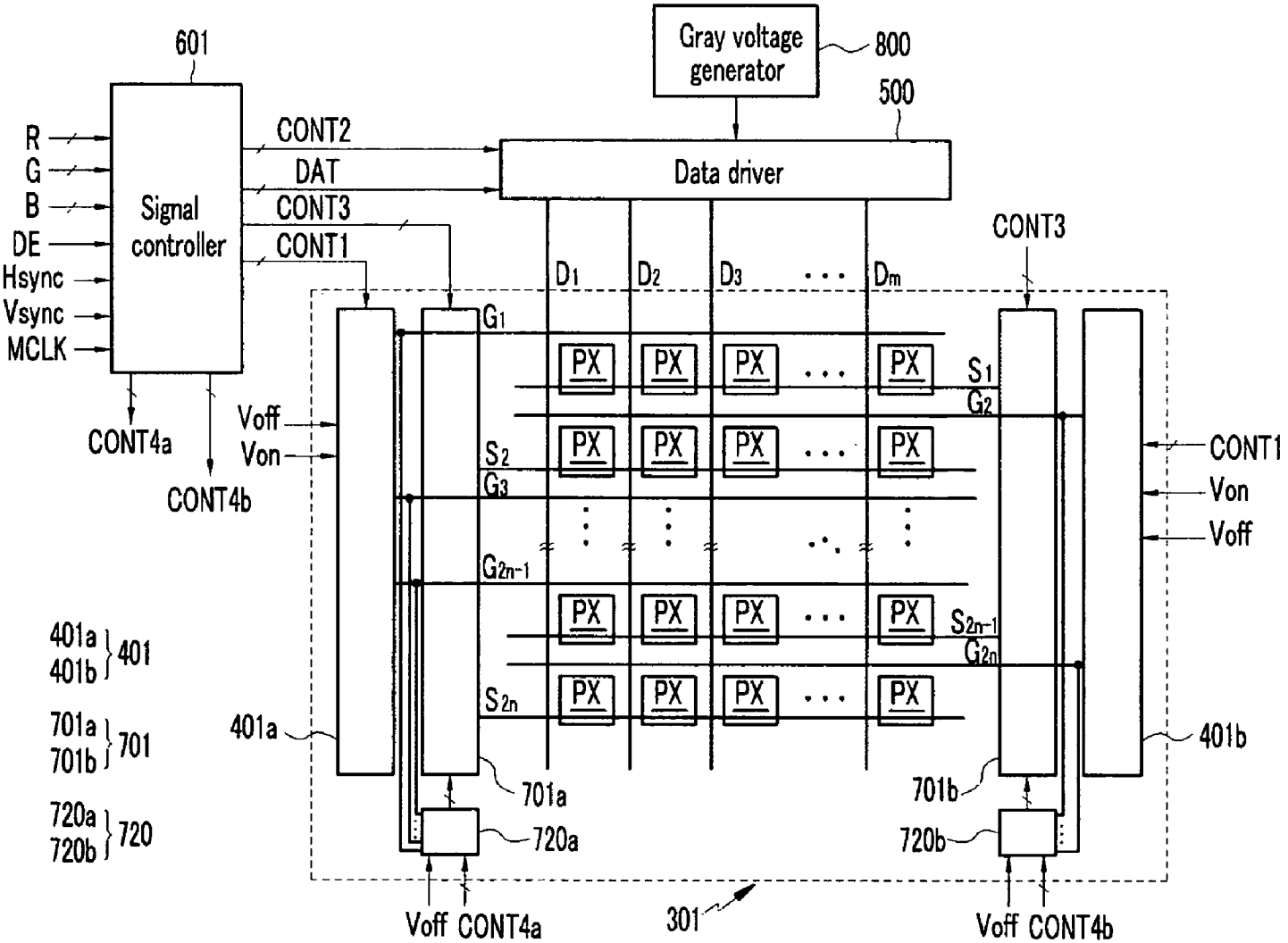
FIG. 5 is a block diagram of a liquid crystal display according to an embodiment of the present invention.
Figure 6:
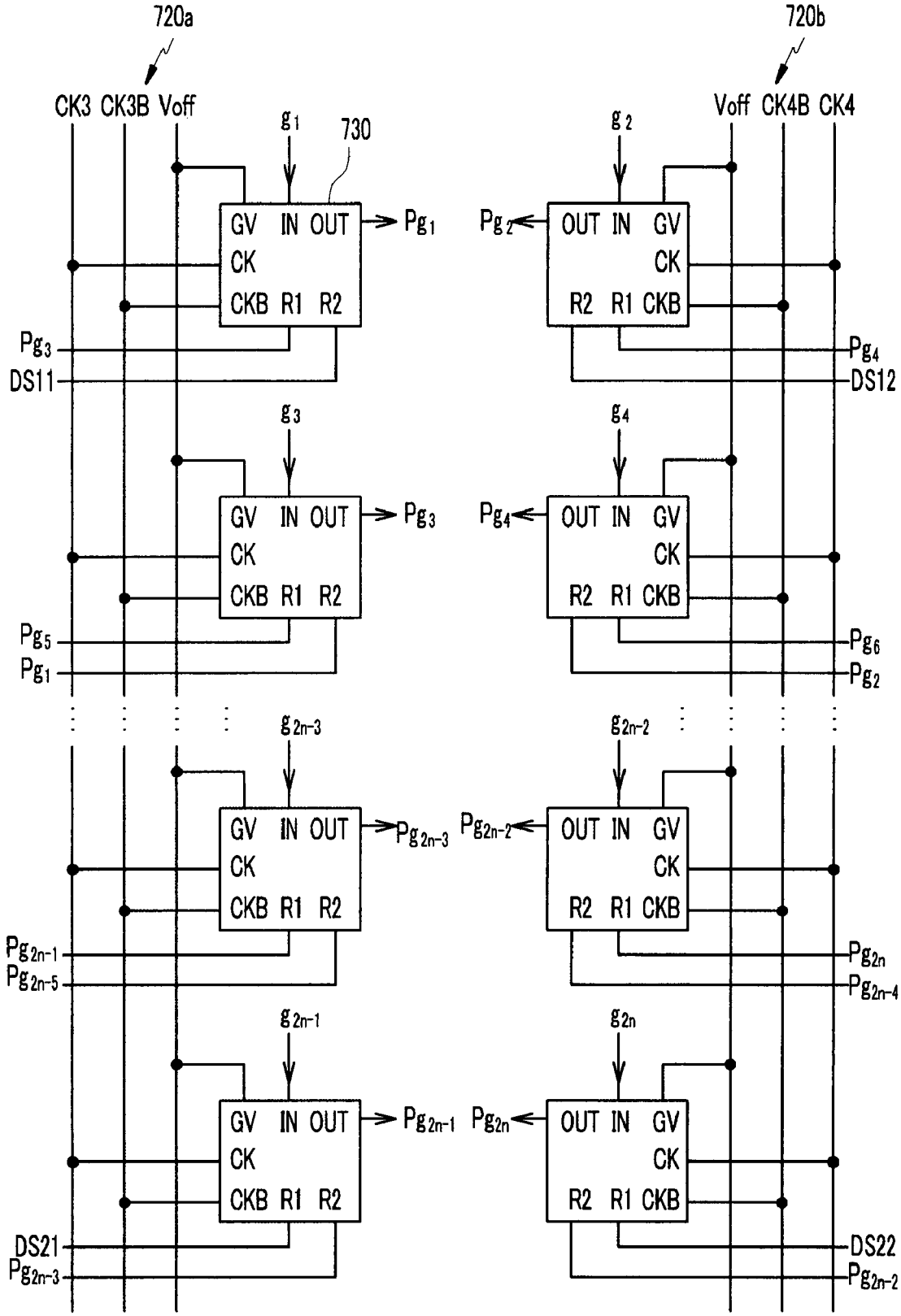
FIG. 6 is a circuit diagram of a pseudo gate signal generating circuit according to an embodiment of the present invention.
Figure 7:
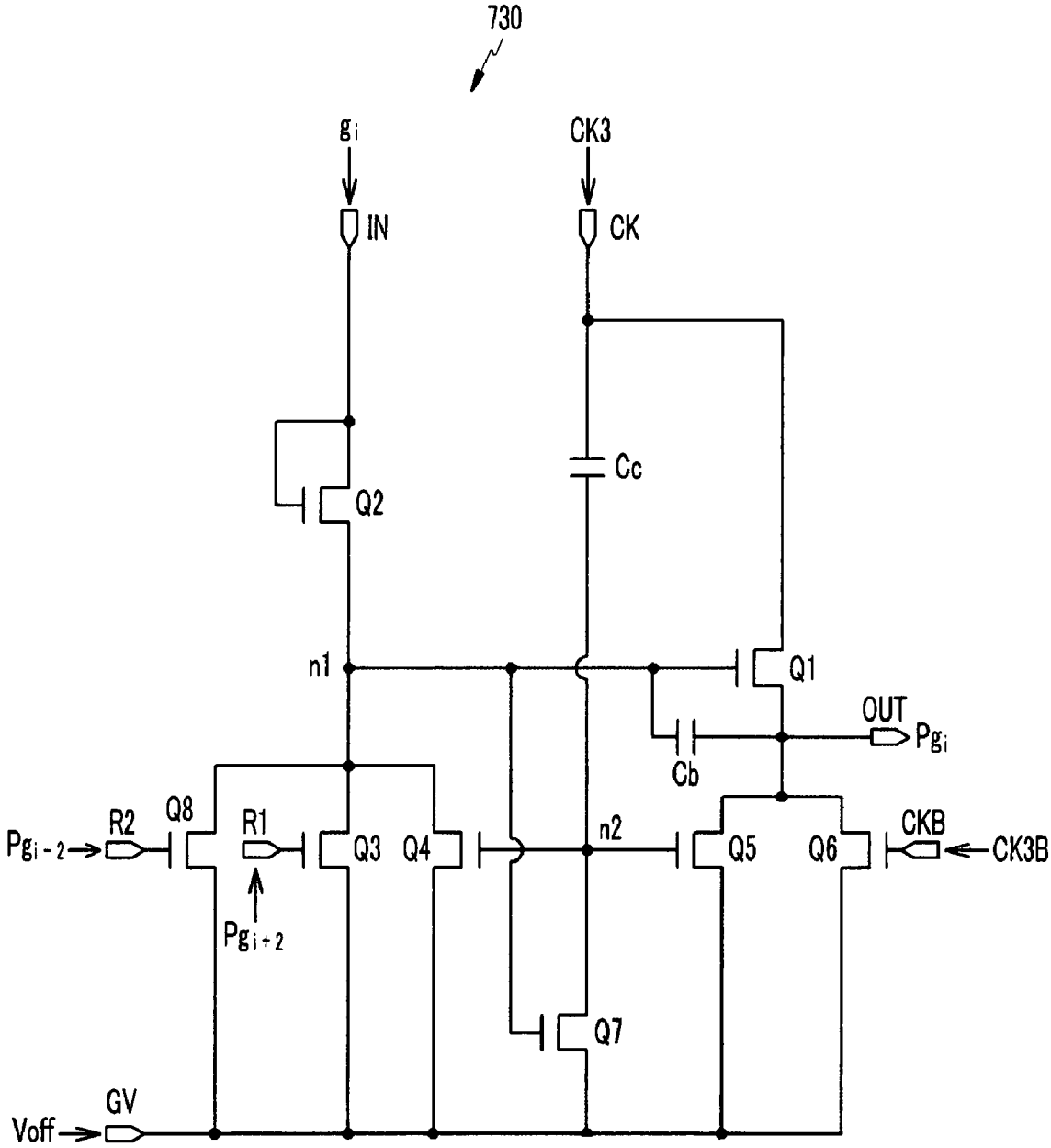
FIG. 7 is a circuit diagram of a pseudo gate driving circuit according to an embodiment of the present invention.
Figure 8:
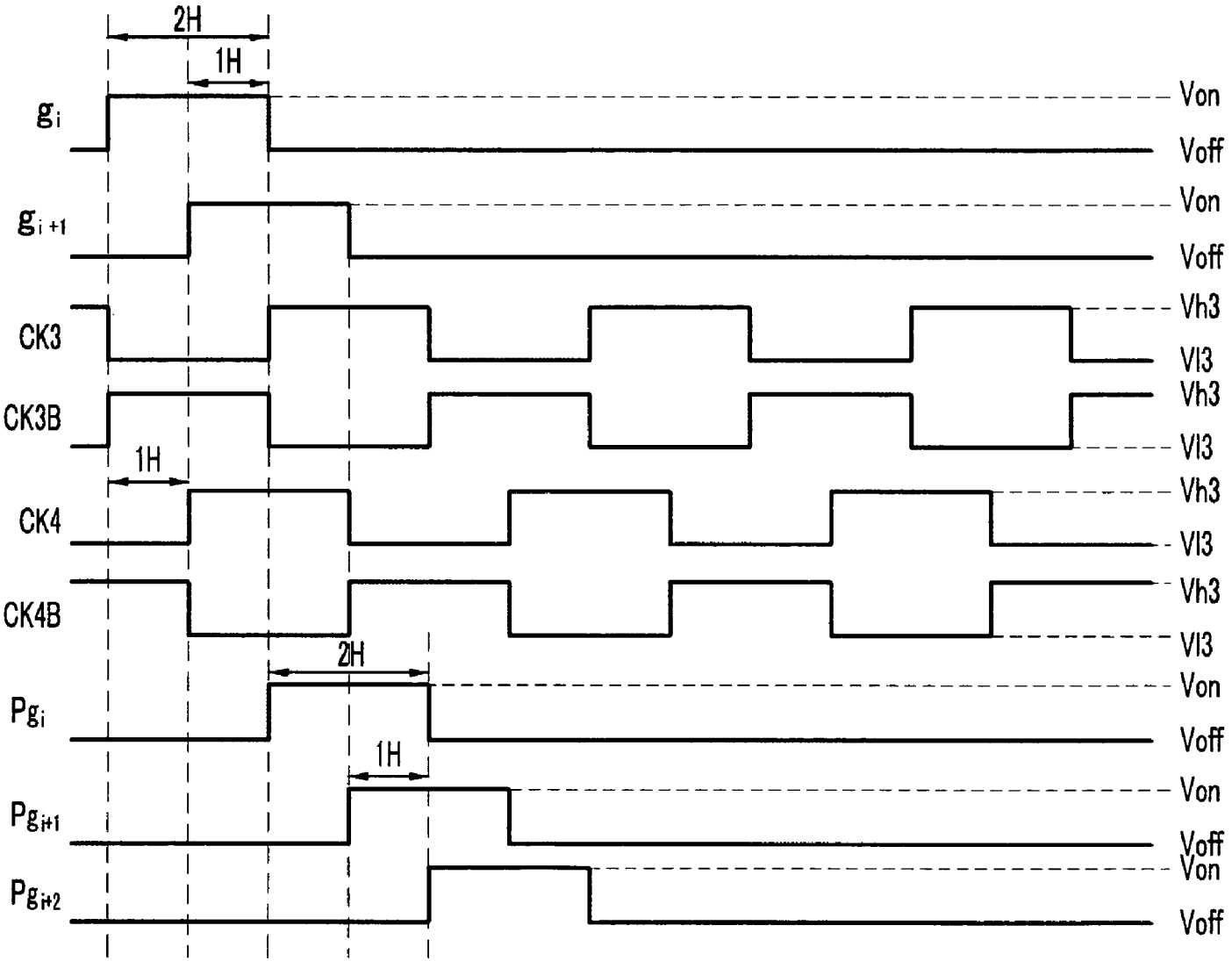
FIG. 8 is a timing diagram of signals used in the liquid crystal display including the pseudo gate driving circuit shown in FIG. 7 according to an embodiment of the present invention.

FIG. 5 is a block diagram of a liquid crystal display according to an embodiment of the present invention, FIG. 6 is a circuit diagram of a pseudo gate signal generating circuit according to an embodiment of the present invention, FIG. 7 is a circuit diagram of a pseudo gate driving circuit according to an embodiment of the present invention, and FIG. 8 is a timing diagram of signals used in the liquid crystal display including the pseudo gate driving circuit shown in FIG. 7.

It will be appreciated that the liquid crystal display shown in FIG. 5 has similarities with the liquid crystal display of FIG. 1. Accordingly, elements in FIG. 5 performing the same operations as those in FIG. 1 are indicated with the same reference numerals, and need not be further described below.

Referring to FIG. 5, the liquid crystal display of this embodiment includes a gate driver 401 connected to normal gate lines $G_1$-$G_{2n}$, a data driver 500 connected to data lines $D_1$-$D_m$, a storage signal generator 701 connected to storage electrode lines $S_1$-$S_{2n}$, a gray voltage generator 800 connected to the data driver 500, and a signal controller 601 connected to the gate driver 401 and the data driver 500.

However, the gate driver 401 of this embodiment is a bi-directional gate driver in which a scanning direction of the normal gate lines $G_1$-$G_{2n}$ is changed based on a selection signal from an external device. That is, based on a state of the selection signal, the gate driver 401 sequentially transmits a gate-on voltage Von in a forward direction, that is, from the first normal gate line $G_1$ to the final normal gate line $G_{2n}$ or in a reverse direction, that is, from the final normal gate line $G_{2n}$ to the first normal gate line $G_1$. For the bi-directional driving of the gate driver 401, the liquid crystal display may further include a selection switch (not shown), that outputs the selection signal having a state defined by the selection of a user, and the signal controller 601 may transmit the selection signal through the gate control signals CONT1 to control the scanning direction of the gate driver 401.

Referring to FIG. 5, the storage signal generator 701 includes first and second storage signal generating circuits 701*a* and 701*b*. However, unlike in FIG. 1, the first storage signal generating circuit 701*a* is connected to even-numbered storage electrode lines $S_2, S_4, \ldots, S_{2n}$, and the second storage signal generating circuit 701*b* is connected to odd-numbered storage electrode lines $S_1, S_3, \ldots, S_{2n-1}$. Compared with the first and second storage signal generating circuits 700*a* and 700*b* shown in FIG. 1, the first and second storage signal generating circuits 701*a* and 701*b* shown in FIG. 5 have substantially the same construction, except for the connection relationship to the storage electrode lines $S_1$-$S_{2n}$. However, the connection relationship between the storage electrode lines $S_1$-$S_{2n}$ and the first and second storage signal generating circuits 701*a* and 701*b* is not limited to the particular embodiment shown in FIG. 5 and may be changed if desired.

Furthermore, unlike in FIG. 1, the liquid crystal display of the embodiment shown in FIG. 5 further includes a pseudo gate signal generator 720 connected to the normal gate lines $G_1$-$G_{2n}$ and the storage signal generator 701. The pseudo gate signal generator 720 includes first and second pseudo gate signal generating circuits 720*a* and 720*b* connected to the first and second storage signal generating circuits 701*a* and 701*b*, respectively.

The first pseudo gate signal generating circuit 720*a* is connected to odd-numbered normal gate lines $G_1, G_3, \ldots,$ and $G_{2n-1}$ and the first storage generating circuit 701*a*. The first pseudo gate signal generating circuit 720*a* transmits pseudo gate signals having a gate-on voltage Von and a gate-off voltage Voff to the input terminals IP of the first storage signal generating circuit 700*a*. The second pseudo gate signal generating circuit 720*b* is connected to even-numbered normal gate lines $G_2, G_4, \ldots,$ and $G_{2n}$ and the second storage generating circuit 701*b*. The second pseudo gate signal generating circuit 720*b* transmits the pseudo gate signals to the input terminals IP of the second storage signal generating circuit 700*b*.

For the operations of the first and second pseudo gate signal generating circuits 720*a* and 720*b*, the signal controller 601 further generates pseudo gate control signals CONT4*a* and CONT4*b*. The pseudo gate signal generator 720 may be integrated into the LC panel assembly 300. In one embodiment, the pseudo gate signal generator 720 may include at least one integrated circuit (IC) chip mounted on the LC panel assembly 300 or on a flexible printed circuit (FPC) film in a tape carrier package (TCP) which are attached to the panel assembly 300. Alternatively, the pseudo gate signal generator 720 may be mounted on a separate printed circuit board (not shown).

As shown in FIG. 6, the first and second pseudo gate signal generating circuits 720*a* and 720*b* are supplied with fourth, fifth, sixth, and seventh clock signals CK3, CK3B, CK4, and CK4B of the pseudo gate control signals CONT4*a* and CONT4*b*, and a gate-off voltage Voff. That is, the first pseudo gate signal generating circuit 720*a* is supplied with the fourth and fifth clock signals CK3 and CK3B of the pseudo gate control signals CONT4*a*, and the second pseudo gate signal generating circuit 720*b* is supplied with the sixth and seventh clock signals CK4 and CK4B of the pseudo gate control signals CONT4*b*. The first and second pseudo gate signal generating circuits 720*a* and 720*b* each include a plurality of pseudo gate driving circuits 730. The pseudo gate driving circuits 730 are connected to the signal generating circuits 710 of the first and second storage signal generating circuits 701*a* and 701*b*, respectively.

Referring to FIG. 6, each of the pseudo gate driving circuits 730 includes an input terminal IN, clock terminals CK and CKB, reset terminals R1 and R2, a gate voltage terminal GV, and an output terminal OUT.

As described above, each of the pseudo gate driving circuits 730 of the first pseudo gate signal generating circuit 720*a* is supplied with an odd-numbered gate signal $g_1$, $g_3, \ldots,$ and $g_{2n-1}$, and each of the pseudo gate driving circuits 730 of the second pseudo gate signal generating circuit 720*b* is supplied with an even-numbered gate signal $g_2, g_4, \ldots,$ and $g_{2n}$.

For example, in an i-th (in this example, i is an odd number) pseudo gate driving circuit 730 included in the first pseudo gate signal generating circuit 720*a*, the input terminal IN is connected to an i-th normal gate line $G_i$ to be supplied with an i-th gate signal $g_i$, the reset terminal R1 is connected to an (i+2)-th pseudo gate signal generating circuit 720*a* to be supplied with an (i+2)-th pseudo gate signal $Pg_{i+2}$, and the reset terminal R2 is connected to an (i−2)-th pseudo gate signal generating circuit 720*a* to be supplied with an (i−2)-th pseudo gate signal $Pg_{i-2}$. The clock terminals CK and CKB are supplied with the fourth and fifth clock signals CK3 and CK3B, respectively, and the output terminal OUT is connected to the input terminal IP of an i-th signal generating circuit 710 of the storage signal generator 701 that is connected to an i-th storage electrode line $S_i$. Like the above description, in an (i+1)-th pseudo gate driving circuit 730 included in the second pseudo gate signal generating circuit 720*b*, the input terminal IN is connected to an (i+1)-th normal gate line $G_{i+1}$ to be supplied with an (i+1)-th gate signal $g_{i+1}$, the reset terminal R1 is connected to an (i+3)-th pseudo gate signal generating circuit 720*b* to be supplied with an (i+3)-th pseudo gate signal $Pg_{i+3}$, and the reset terminal R2 is connected to an (i−3)-th pseudo gate signal generating circuit 720*b* to be supplied with an (i−3)-th pseudo gate signal $Pg_{i-3}$. The clock terminals CK and CKB are supplied with the sixth and seventh clock signals CK4 and CK4B, respectively, and the output terminal OUT is connected to the input terminal IP of an (i+1)-th signal generating circuit 710 of the storage signal generator 701 that is connected to an (i+1)-th storage electrode line $S_{i-1}$.

However, the reset terminals R2 of the first pseudo gate driving circuits 730 of the first and second pseudo gate signal generating circuits 720*a* and 720*b* are connected to dummy signals DS11 and DS12 instead of the pseudo gate signals, respectively, and the reset terminals R1 of the final pseudo gate driving circuits 730 of the first and second pseudo gate signal generating circuits 720*a* and 720*b* are connected to dummy signals DS21 and DS22, respectively. The dummy signals DS1, DS12, DS21, DS22 may be generated in the signal controller 601 based on the scanning start signals. Alternatively, the dummy signals DS11, DS12, DS21, and DS22 may be supplied by the gate driver 401 through additional gate lines that are connected to the gate driver 401.

Referring to FIG. 8, the clock signals CK3, CK3B, CK4, and CK4B include a high level voltage Vh3 and a low level voltage Vl3. The high level voltage Vh3 may be the same as a gate-on voltage Von, and the low level voltage Vl3 may be the same as a gate-off voltage Voff. Furthermore, the pulse width of the clock signals CK3, CK3B, CK4, and CK4B is substantially the same as the pulse width of a gate-on voltage Von, and the clock signals CK3, CK3B, CK4, and CK4B have a period of about 4H and a duty ratio of about 50%. The clock signals CK3 and CK3B, and the clock signals CK4 and CK4B have a phase difference of about 180 degrees with respect to each other, and therefore are inverted with respect to each other. The clock signals CK3 and CK4 have a phase difference of about 90° with respect to each other.

Referring to FIG. 7, each of the pseudo gate driving circuits 730 include a plurality of transistors Q1-Q8 each of which includes a control terminal, an input terminal, and an output terminal, and two capacitors Cc and Cb. The transistors Q1-Q8 are illustrated in FIG. 7 as NMOS transistors, but may be implemented as PMOS transistors. The capacitance Cc and Cb may be parasitic capacitance occurring between a gate terminal and drain/source terminals in manufacturing.

The input terminal of the transistor Q1 is connected to the clock terminal CK, and the output terminal of the transistor Q1 is connected to the output terminal OUT.

The input and control terminals of the transistor Q2 are connected to the input terminal IN, and the output terminal of the transistor Q2 is connected to the control terminal of the transistor Q1 via a node n1.

The input terminal of the transistor Q3 is connected to the output terminal of the transistor Q2 through the node n1, the control terminal of the transistor Q3 is connected to the reset terminal R1, and the output terminal of the transistor Q3 is connected to the gate voltage terminal GV.

The input terminal of the transistor Q4 is connected to the output terminal of the transistor Q2 through the node n1, and the output terminal of the transistor Q4 is connected to the gate-off voltage Voff.

The input terminal of the transistor Q5 is connected to the output terminal of the transistor Q1, the control terminal of the transistor Q5 is connected to the control terminal of the transistor Q4, and the output terminal of the transistor Q5 is connected to the gate-off voltage Voff.

The input terminal of the transistor Q6 is connected to the output terminal of the transistor Q1, the control terminal of the transistor Q6 is connected to the clock terminal CKB, and the output terminal of the transistor Q6 is connected to the gate voltage terminal GV.

The input terminal of the transistor Q7 is connected to the control terminals of the transistors Q4 and Q5 through a node n2, the control terminal of the transistor Q7 is connected to the output terminal of the transistor Q2 through the node n1, and the output terminal of the transistor Q7 is connected to the gate voltage terminal GV.

The input terminal of the transistor Q8 is connected to the output terminal of the transistor Q2 through a node n1, the control terminal of the transistor Q8 is connected to the reset terminal R2, and the output terminal of the transistor Q8 is connected to the gate voltage terminal GV.

The capacitor Cc is connected to the third clock signal CK2 and the node n2, and the capacitor Cb is connected to the node n1 and the output terminal OUT.

The operation of the pseudo gate driving circuit 730 will now be described, initially when the scanning direction of the gate driver 401 defined by the state of the selection signal is the forward direction. It is assumed that the transistors Q1-Q8 are initially turned on or off by the gate-on voltage Von or the gate-off voltage Voff.

First, the operation of an i-th pseudo gate driver 730 circuit will be described. When the fourth clock signal CK3 is changed from a high level voltage Vh2 to a low level voltage Vl3, and voltage levels of the fifth clock signal CK3B and a gate signal $g_i$ applied to the input terminal IN are changed from a gate-off voltage Voff to a gate-on voltage Von, the transistors Q2 and Q6 are turned on. Hence, the gate-on voltage Von is transmitted to the node n1 through the transistor Q2, and thereby the transistors Q4 and Q5 are turned off. At this time, since a voltage level of an (i+2)-th pseudo gate signal $Pg_{i+2}$ is the gate-off voltage Voff, the transistor Q3 maintains a turned-off state. Meanwhile, the output terminal OUT outputs the gate-off voltage Voff to the input terminal IP of the i-th signal generating circuit 710 through the two turned-on transistors Q1 and Q6 as an i-th pseudo gate signal $Pg_i$.

At this time, the capacitor Cb is charged with the voltage corresponding to the difference between the gate-on voltage Von and the gate-off voltage Voff. The state of the node n2 maintains a low level voltage by the low level voltage Vl3 of the fourth clock signal CK3.

Next, when voltage levels of the i-th gate signal $g_i$ and the fifth clock signal CK3B are changed to the gate-off voltage Voff and the low level voltage Vl3, respectively, and the fourth clock signal CK3 transitions from the low level voltage Vl3 to the high level voltage Vh3, the transistors Q2 and Q6 are turned off. At this time, since the pseudo gate signal $Pg_{i+2}$ maintains the low level, the transistor Q3 maintains a turned-off state as well. As the transistor Q2 is turned off, the node n1 is disconnected from the i-th gate signal $g_i$ and comes to be in a floating state. Accordingly, the transistors Q1 and Q7 maintain a turned-on state to apply the gate-off voltage to the node n2, and thereby the transistors Q4 and Q5 each maintain a turned-off state. Since the transistors Q5 and Q6 both enter a turned-off state, the gate-off voltage Voff transferred to the output terminal OUT is disconnected. Since the transistor Q1 maintains a turned-on state, only the gate-on voltage Von, which is the high level voltage Vh3 of the clock signal CK3, is transferred to the output terminal OUT and outputted. At this time, since the capacitor Cb maintains a constant voltage, as the voltage of the output terminal OUT increases to the gate-on voltage Von, the voltage of the node n1 in the floating state exhibits a corresponding increase in voltage.

The capacitor Cc is charged with the voltage corresponding to the difference between the gate-on voltage Von of the fourth clock signal CK3 and the gate-off voltage Voff, which is a voltage of the node n2. Hence, the node n2 maintains the low voltage such that the transistor Q5 maintains the turned-off state. Accordingly, the stable output of the gate-on voltage Von to the output terminal OUT is maintained.

When the fourth clock signal CK3 is shifted to the low level voltage Vl3, and the fifth clock signal CK3B and the pseudo gate signal $Pg_{i+2}$ are shifted to the high level voltage Vh3 and the gate-on voltage, respectively, the transistors Q3 and Q6 are turned on. At this time, since the gate signal $g_i$ maintains the gate-off voltage Voff, the transistor Q2 maintains a turned-off state. As the transistor Q3 is turned on, the gate-off voltage Voff is transferred to the node n1, thereby turning off the transistors Q1 and Q7.

When the transistor Q7 is turned off, the node n2 enters into the floating state. At this time, since the capacitor Cc maintains a constant voltage, as the fourth clock signal CK3 is shifted to the low level voltage Vl3, the voltage of the node n2 drops below the gate-off voltage Voff. However, if the voltage of the node n2 drops below the gate-off voltage Voff, the transistor Q7 is turned on again to transfer the gate-off voltage Voff to the node n2. Thus, in the final equilibrium state, the voltage of the node n2 is almost the same as the gate-off voltage Voff. Subsequently, the transistors Q4 and Q5 continuously maintain the turned-off state.

In the meantime, since the transistor Q1 is turned off and the transistor Q6 is turned on, the gate-off voltage Voff is transferred to the output terminal OUT, and the capacitor Cb is discharged.

Thereafter, only the fourth and fifth clock signals CK3 and CK3B repeat the high level voltage Vh3 and the low level Voltage Vl3. However, a level change of the fourth clock signal CK3 periodically turns the transistor Q5 on and off, and a level change of the fifth clock signal CK3B periodically turns the transistor Q6 on and off. Accordingly, since the gate-off voltage Voff is continuously applied to the output terminal OUT, the voltage level of the output terminal OUT uniformly maintains the gate-off voltage Voff regardless of the change of the fourth clock signal CK3. Furthermore, when the fourth clock signal CK3 is the high level voltage Vh3, the transistor Q6 is turned on, and the node n1 is thereby supplied with the gate-off voltage Voff. Hence, the state of the node n1 is uniformly the gate-off voltage Voff.

In this case, the reset terminal R2 connected to the control terminal of the transistor Q8 is supplied with the previous gate signal $g_{i-2}$ of the gate-off voltage Voff, thereby maintaining the turned-off state.

As shown in FIG. 8, in the i-th pseudo gate driving circuit 730, the application time of the gate-on voltage Von of the normal gate signal $g_i$ applied to the input terminal IN and the application time of the gate-on voltage Von of the pseudo gate signal $Pg_i$ from the output terminal OUT have the difference of about 2H. Hence, the pseudo gate signal $Pg_i$ is substantially the same as an (i+2)-th gate signal $g_{i+2}$, and the pseudo gate signal $Pg_{i+1}$ from the (i+1)-th pseudo gate driving circuit 730 is substantially the same as an (i+3)-th gate signal $g_{i+3}$.

However, when the scanning direction defined by the state of the selection signal is the reverse direction, the i-th pseudo gate driving circuit 730 generates the i-th pseudo gate signal $Pg_i$ by the operations of the transistors Q1, Q2, and Q4-Q7 and the capacitors Cc and Cb as described above, thereby outputting to the i-th signal generating circuit 710 through the output terminal OUT. However, unlike the case of the forward direction, the transistor Q8 to which the pseudo gate signal $Pg_{i-2}$ is applied takes the place of the function of the transistor Q3 to which the pseudo gate signal $Pg_{i+2}$ is applied.

As described above, instead of the storage signal generator 700 and the gate lines $G_2$-$G_{2d}$, and $G_d$ being directly connected as shown in FIG. 1, the LCD of this embodiment further includes the pseudo gate signal generator that generates pseudo gate signals substantially equal to the gate signals. Advantageously, the pseudo gate signal generator may be used to provide bi-directional gate driving in this embodiment without a separate selection circuit such as a multiplexer. This embodiment may also provide the advantages of the embodiment referred to in FIGS. 1 to 4.

That is, when the gate driver is implemented as a bi-directional gate driver with a separate selection circuit (e.g., a multiplexer) that selects one of the previous and next gate signals, the selection circuit can cause manufacturing difficulties. However, the pseudo gate signal generator described above may be integrated into the LC panel assembly 301 along with the signal lines $G_1$-$G_n$, $D_1$-$D_m$, and $S_1$-$S_n$, and thereby the pseudo gate signals applied as the input signals of the storage signal generator are directly generated. As a result, the storage signal generator may be implemented in the LCD using the bi-directional gate driver.

Advantageously, the pseudo gate signal generator may be manufactured using transistors of a smaller size than those of the gate driver such that redundancy of the LCD is not largely influenced.

In the embodiments described above, the gate drivers 400 and 401 and the storage signal generators 700 and 701 are disposed at both sides of the LC panel assemblies 300 and 301, respectively. However, it will be appreciated that embodiments in accordance with the present invention are not limited thereto. In this regard, a gate driver and a storage signal generator may alternatively be disposed on one side of the LC panel assemblies 300 and 301 may be used. In this case, the number of pseudo gate signal generators connected to the storage signal generator may be one.

According to an embodiment of the present invention, two adjacent gate-on voltages overlap for a predetermined period, but the storage signal generator may be used in a case that two adjacent gate-on voltages do not overlap. In this case, the pseudo gate signal generator may control the pulse width of the fourth and fifth pulse signals and the sixth and seventh pulse signals to generate pseudo gate signals applied to the storage signal generator.

According to another embodiment of the present invention, after the common voltage is fixed to be a predetermined voltage, the storage signals of which levels are changed in a predetermined period are applied to the storage electrode lines. Thereby, since a range of the pixel electrode voltage is widened, a range of the pixel voltage is also widened. Since a range of voltage for representing grays is widened, image quality can be improved.

Furthermore, in a case where the data voltages having the same magnitude are applied, a wide range of pixel voltages can be generated in comparison with implementations where a constant storage signal is applied. As a result, power consumption may be reduced. In addition, because the common voltage may be fixed to be a constant value, power consumption can be further reduced.

Advantageously, an LCD having the bi-directional gate driver and the storage signal generator may be implemented without a separate selection circuit.

While this invention has been described in connection with what is presently considered to be practical exemplary embodiments, it is to be understood by those ordinarily skilled in the art that the invention is not limited to the disclosed embodiments, but, on the contrary, is intended to cover various modifications and equivalent arrangements included within the spirit and scope of the appended claims.

What is claimed is:

1. A display device comprising:

a plurality of gate lines adapted to transmit a plurality of normal gate signals having a gate-on voltage and a gate-off voltage;

a plurality of data lines crossing the gate lines and adapted to transmit a plurality of data voltages;

a plurality of storage electrode lines substantially parallel to the gate lines and adapted to transmit a plurality of storage signals;

a plurality of pixels arranged in a matrix having a plurality of rows, wherein each pixel comprises a switching element connected to one of the gate lines and one of the data lines, a liquid crystal capacitor connected to the switching element and a common voltage, and a storage capacitor connected to the switching element and one of the storage electrode lines;

a plurality of pseudo gate driving circuits connected to the gate lines and adapted to generate a plurality of pseudo gate signals based on the normal gate signals; and a plurality of storage signal generating circuits connected to the storage electrode lines and adapted to generate the storage signals based on the pseudo gate signals, wherein each of the storage signal generating circuits is adapted to apply an associated storage signal to an associated one of the storage electrode lines after the liquid crystal capacitor and storage capacitors of an associated row of pixels have been charged by the data voltages, wherein each of the storage signal generating circuits is adapted to change a voltage of its associated storage signal from a low level to a high level if the data voltages have a positive polarity, and from the high level to the low level if the data voltages have a negative polarity.

2. The display device of claim 1, wherein the pseudo gate driving circuits are adapted to delay the normal gate signals for a predetermined time to generate the pseudo gate signals.

3. The display device of claim 2, wherein the predetermined time is about two horizontal periods (2H).

4. The display device of claim 3, wherein the common voltage is a constant voltage.

5. The display device of claim 4, further comprising a bi-directional gate driver connected to the gate lines and adapted to generate the normal gate signals.

6. The display device of claim 4, wherein each pseudo gate driving circuit comprises:

an input unit adapted to provide an output voltage in response to a normal gate signal associated with one of the gate lines;

an output unit adapted to provide one of the pseudo gate signals from a first clock signal based on a state of the output voltage;

a stabilization unit connected to the output unit and supplied with the gate-off voltage, a second clock signal, and the output voltage, wherein the stabilization unit is adapted to stabilize a state of the pseudo gate signal in response to a state change of the first clock signal; and a reset unit connected to the stabilization unit and supplied with the gate-off voltage, a next pseudo gate signal associated with a next pseudo gate driving circuit next to the pseudo gate driving circuit, a previous pseudo gate signal associated with a previous pseudo gate driving circuit previous to the pseudo gate driving circuit, and the output voltage, wherein the reset unit is adapted to stabilize a state of the output voltage in response to the state change of the first clock signal, and further adapted to reset an operation of the pseudo gate driving circuit.

7. The display device of claim 6, wherein the second clock signal has a pulse width substantially the same as the gate-on voltage, and the second clock signal has a phase difference of about 180 degrees with respect to the first clock signal.

8. The display device of claim 6, wherein the first clock signal and the second clock signal each have a high level voltage substantially equal to the gate-on voltage and a low level voltage substantially equal to the gate-off voltage.

9. The display device of claim 6, wherein a difference between application times of gate-on voltages of the normal gate signal and the next pseudo gate signal or the next pseudo gate signal is about two horizontal periods (2H).

10. The display device of claim 6, wherein the input unit comprises a first switching element having an input terminal and a control terminal each connected to the normal gate signal, and an output terminal adapted to provide the output voltage.

11. The display device of claim 10, wherein the output unit comprises:

a second switching element comprising an input terminal connected to the first clock signal, a control terminal connected to the output voltage, and an output terminal adapted to provide the pseudo gate signal; and a first capacitor connected to the control terminal and the output terminal of the second switching element.

12. The display device of claim 10, wherein the stabilization unit comprises:

a third switching element comprising an input terminal connected to the output terminal of the second switching element, a control terminal connected to the second clock signal, and an output terminal connected to the gate-off voltage;

a fourth switching element comprising an input terminal connected to the output terminal of the second switching element and an output terminal connected to the gate-off voltage;

a second capacitor connected to the first clock signal and the control terminal of the fourth switching element; and a fifth switching element comprising an input terminal connected to the control terminal of the fourth switching element, a control terminal connected to the output voltage, and an output terminal connected to the gate-off voltage.

13. The display device of claim 10, wherein the reset unit comprises:

a sixth switching element comprising an input terminal connected to the output voltage, a control terminal connected to the control terminal of the fourth switching element, and an output terminal connected to the gate-off voltage;

a seventh switching element comprising an input terminal connected to the output voltage, a control terminal connected to the next pseudo gate signal, and an output terminal connected to the gate-off voltage; and an eighth switching element comprising an input terminal connected to the output voltage, a control terminal connected to the previous pseudo gate signal, and an output terminal connected to the gate-off voltage.

14. The display device of claim 1, wherein the display device is configured to display images in a plurality of frames, wherein each storage signal generating circuit is adapted to reverse a voltage level of its generated storage signal for every frame.

15. A method of driving a display device having a plurality of pixels arranged in a matrix having a plurality of rows, wherein each pixel comprises a switching element connected to one of a plurality of gate lines and one of a plurality of data lines, a liquid crystal capacitor connected to the switching element and a common voltage, and a storage capacitor connected to the switching element and one of a plurality of storage electrode lines, the method comprising:

applying a first set of data voltages to the data lines;

generating a first normal gate signal;

applying the first normal gate signal to a first gate line connected with a first row of pixels;

charging the liquid crystal capacitor and storage capacitors of the first row of pixels with the first set of data voltages;

generating a first pseudo gate signal based on the first normal gate signal;

generating a first storage signal based on the first pseudo gate signal;

applying the first storage signal to a first storage electrode line connected with the first row of pixels to maintain a voltage of the first storage signal on the storage capacitors of the first row of pixels; and repeating the preceding operations for a second set of data voltages, a second normal gate signal, a second pseudo gate signal, a second gate line connected with a second row of pixels, a second storage electrode line, and a second storage signal; and changing the voltages of the first and second storage signals from a low level to a high level if the data voltages have a positive polarity, and from the high level to the low level if the data voltages have a negative polarity.

16. The method of claim 15, wherein the generating the first pseudo gate signal comprises delaying the first normal gate signal by a predetermined time, and wherein the generating the second pseudo gate signal comprises delaying the second normal gate signal by the predetermined time.

17. The method of claim 16, wherein the predetermined time is about two horizontal periods (2H).

18. A display device comprising:

a plurality of gate lines adapted to transmit a plurality of normal gate signals having a gate-on voltage and a gate-off voltage;

a plurality of data lines crossing the gate lines and adapted to transmit a plurality of data voltages;

a plurality of storage electrode lines substantially parallel to the gate lines and adapted to transmit a plurality of storage signals;

a plurality of pixels arranged in a matrix having a plurality of rows, wherein each pixel comprises a switching element connected to one of the gate lines and one of the data lines, a liquid crystal capacitor connected to the switching element and a common voltage, and a storage capacitor connected to the switching element and one of the storage electrode lines;

means for generating a plurality of pseudo gate signals based on the normal gate signals;

means for generating the storage signals based on the pseudo gate signals; and means for applying an associated storage signal to an associated one of the storage electrode lines after the liquid crystal capacitor and storage capacitors of an associated row of pixels have been charged by the data voltages, wherein each of the storage signal generating circuits is adapted to change a voltage of its associated storage signal from a low level to a high level if the data voltages have a positive polarity, and from the high level to the low level if the data voltages have a negative polarity.

* * * * *